US011453934B2

(12) United States Patent
Liu et al.

(10) Patent No.: US 11,453,934 B2
(45) Date of Patent: Sep. 27, 2022

(54) HIGH-STRENGTH HIGH-TOUGHNESS LOW-TEMPERATURE THICK-PLATE STRUCTURAL STEEL AND HEAT TREATMENT METHOD THEREOF

(71) Applicant: Shanghai Jiao Tong University, Shanghai (CN)

(72) Inventors: Qingdong Liu, Shanghai (CN); Wei Hou, Shanghai (CN); Jianfeng Gu, Shanghai (CN)

(73) Assignee: Shanghai Jiao Tong University

( * ) Notice: Subject to any disclaimer, the term of this patent is extended or adjusted under 35 U.S.C. 154(b) by 116 days.

(21) Appl. No.: 17/019,472

(22) Filed: Sep. 14, 2020

(65) Prior Publication Data

US 2021/0130941 A1 May 6, 2021

(30) Foreign Application Priority Data

Oct. 31, 2019 (CN) ..... 201911053453.X

(51) Int. Cl.

| | |
|---|---|
| ***C22C 38/48*** | (2006.01) |
| ***C21D 8/02*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |

(Continued)

(52) U.S. Cl.

CPC ..... *C22C 38/48* (2013.01); *C21D 1/18* (2013.01); *C21D 8/0205* (2013.01); *C21D 8/0226* (2013.01); *C21D 8/0263* (2013.01); *C21D 9/46* (2013.01); *C22C 38/002* (2013.01); *C22C 38/04* (2013.01); *C22C 38/06* (2013.01); *C22C 38/42* (2013.01); *C22C 38/46* (2013.01); *C21D 2211/005* (2013.01); *C21D 2211/008* (2013.01)

(58) Field of Classification Search

CPC ..... C21D 1/18; C21D 2211/005; C21D 2211/008; C21D 8/0205; C21D 8/0226; C21D 8/0263; C21D 9/46; C22C 38/002; C22C 38/04; C22C 38/42; C22C 38/46; C22C 38/48

USPC ..... 148/326

See application file for complete search history.

(56) References Cited

U.S. PATENT DOCUMENTS 6,558,483 B2 * 5/2003 Nakamura ..... C22C 38/08 420/92

7,354,487 B2 * 4/2008 Dierickx ..... C22C 38/58 148/624

* cited by examiner

*Primary Examiner* — Jie Yang

(74) *Attorney, Agent, or Firm* — McDonnell Boehnen Hulbert & Berghoff LLP

(57) ABSTRACT

The present invention relates to high-strength high-toughness low-temperature thick-plate structural steel and a heat treatment method thereof. The steel is composed of the following components by weight percentage: C: 0.03-0.08%, Cr: 0.8-1.9%, Mn: 0.01-1.0%, Ni: 3.5-7%, Mo: 0.2-0.5%, V: 0.15-0.2%, Nb: 0.01-0.05%, Cu: 1.2-3.8%, Al: 0-0.5%, P: <0.015%, S: <0.010%, and Fe and inevitable impurities as balance. Compared with the prior art, a steel plate prepared in the present invention can be used at low temperature of −20 to −120° C. and −196° C., maintains relatively high strength and certain toughness, and mainly resolves a technical problem that existing high-strength high-toughness quenched and tempered steel cannot meet equipment requirements in polar resource and energy development; transportation, etc.

13 Claims, 4 Drawing Sheets

(51) Int. Cl.
*C22C 38/46* (2006.01)
*C21D 1/18* (2006.01)

HIGH-STRENGTH HIGH-TOUGHNESS LOW-TEMPERATURE THICK-PLATE STRUCTURAL STEEL AND HEAT TREATMENT METHOD THEREOF

CROSS REFERENCE TO RELATED APPLICATION

The present application claims priority to Chinese Patent Application No. 201911053453. X, filed Oct. 31, 2019, which is incorporated by reference herein in its entirety.

TECHNICAL FIELD

The present invention relates to the field of low-temperature thick-plate structural steel, and in particular, to high-strength high-toughness low-temperature thick-plate structural steel and a heat treatment method thereof.

BACKGROUND

The microscopic structure and nanostructure adjustment based on the precipitation and phase transformation theory has been a main means to strengthening and toughening advanced steel materials, and is also a theoretical basis for developing a new generation of high-strength and high-toughness steel. An extremely ideal microscopic structure and excellent mechanical properties can be obtained through adjustment by ingeniously utilizing a coupling effect of "force" and "heat" during hot processing. For example, grains of conventional low alloy steel can be significantly refined by repeated low-temperature deformation in combination with tempering, thereby improving the low-temperature toughness of the low alloy steel; and austenite at room temperature can achieve higher stability through rapid heating, instantaneous heat preservation, and cyclic phase transformation, thereby improving the strength, plasticity, etc. of automotive steel. However, for ultra-thick marine engineering steel and shipbuilding steel, it is difficult or impossible to implement hot/cold processing with large deformation and rapid cooling processes in engineering, especially when a dislocation pattern, a fine-grain interface, a heterostructure, etc introduced by the processes are in thermodynamically metastable states, even if extremely good material properties (such as the strength and plasticity) in static or quasi-static conditions are obtained, it is still difficult to ensure the plasticity and toughness under high-speed impact load, and fatigue and corrosion (especially stress corrosion) performance during long-term service. If "external force" and "rapid cooling" are not well utilized to introduce sufficient material defects (such as vacancies and dislocations) to "interfere with" dynamic processes of diffusion, segregation, and distribution of alloying elements to the utmost extent, or a microscopic structure and mechanical properties are adjusted by increasing a precipitation nucleation rate and a subcooling degree of phase transformation, some policies for improving the strong plasticity/toughness by hot/cold processing cannot be well "grafted" to thick-plate structural steel. During heat treatment (such as quenching and tempering), sufficient diffusion of alloying elements makes a microscopic structure and a nanostructure tend to be in a thermodynamic equilibrium state. This can only "compromise" the balance of precipitation strengthening, phase-transformation toughening, and fine grain strengthening and toughening. It is extremely difficult to ensure a ratio between strength, plasticity, and low-temperature toughness of ultra-thick structural steel, even without considering the influence of casting defects. However, with the update and development of the multi-scale analysis and characterization technology, thermodynamic and kinetic factors that control the precipitation and phase transformation reaction progress are being continually explored at an atomic scale, thereby forming a new theory of composite strengthening of a nano-precipitated phase and toughening of reverse transformed austenite, and forming a multi-step heat treatment technology integrating reverse phase-transformation treatment of austenite or critical tempering in a two-phase region on a basis of improving and optimizing a conventional quenching and tempering heat-treatment process. This will form a basis for heat treatment for successfully developing high-performance, high-strength, high-toughness, and low-temperature steel together with a grain refinement process of cycle annealing (normalizing or normalizing+critical tempering in a two-phase region).

However, multi-step heat treatment is a general concept. Although purposes of the multi-step heat treatment are clear, namely, 1) to implement fine grain strengthening and toughening through cycle annealing; 2) to implement toughening of reverse transformed austenite through critical tempering in a two-phase region; and 3) to implement precipitation strengthening of a nano-second phase through conventional tempering, it lacks necessary and specific criteria for selecting parameters such as heat treatment temperature, time, and steps. This requires an in-depth understanding of the law of precipitation and a phase transformation reaction in a specific heat treatment step, as well as an interaction effect between multiple steps, so as to obtain a microscopic structure and a nanostructure that are beneficial to the strength and toughness improvement, and evaluate their micromechanical behavior and fracture failure mechanisms under applied load. This further provides theoretical guidance for optimizing and determining parameters of the multi-step heat treatment process.

SUMMARY

An objective of the present invention is to provide high-strength high-toughness low-temperature thick-plate structural steel and a heat treatment method thereof, to overcome the above defects in the prior art. Beneficial effects of alloying elements are fully utilized, especially roles of elements such as Ni and Cu in a precipitation and phase transformation process. A flexible multi-step heat treatment process for coupling precipitation strengthening of nano-clusters, reverse-phase-transformation toughening of austenite, and fine grain strengthening and toughening is developed and optimized, so as to obtain a thermodynamically stable microscopic structure and nanostructure. This can further increase a strength/toughness ratio of advanced thick-plate structural steel, to replace existing commercial alloy steel to reduce costs and improve the reliability.

The objective of the present invention can be achieved according to the following technical solutions.

The present invention provides high-strength high-toughness low-temperature thick-plate structural steel composed of the following components by weight percentage:

C: 0.03-0.08%, Cr: 0.8-1.9%, Mn: 0.01-1.0%, Ni: 3.5-7%, Mo: 0.2-0.5%, V: 0.15-0.2%, Nb: 0.01-0.05%, Cu: 1.2-3.8%, Al: 0-0.5%, P: <0.015%, S: <0.010%, and Fe and inevitable impurities as balance.

The present invention further provides a heat treatment method of high-strength high-toughness low-temperature thick-plate structural steel, including the following steps:

(1) conducting smelting according to a ratio to form a steel ingot or an ingot blank, and soaking at 1150-1250° C.; conducting a total of not less than 12 passes of rough rolling and finish rolling, where the final rolling temperature is not lower than 750° C., and a cumulative compression ratio is 4-7; and conducting air cooling or water cooling; and (2) conducting off-line heat treatment:

(2-a) quenching, denoted as Q: conducting austenization at 870-915° C. for 40-120 min, followed by water cooling;

(2-b) critical tempering in a two-phase region, denoted as L: conducting high-temperature tempering at 625-680° C. for 40-60 min, followed by water cooling; and (2-c) tempering, denoted as T: conducting tempering at 525-575° C. for 30-360 min, followed by air cooling; where when air cooling is conducted after rolling in step (1), the off-line heat treatment includes step (2-a), step (2-b), and step (2-c) to obtain the high-strength high-toughness low-temperature thick-plate structural steel; and when water cooling is conducted after rolling in step (1), the off-line heat treatment includes step (2-a), step (2-b), and step (2-c), or sequentially conducting step (2-b) and step (2-c), to obtain the high-strength high-toughness low-temperature thick-plate structural steel.

Preferably, in step (1), when water cooling is conducted after rolling, a theoretical critical cooling rate for obtaining complete martensite is approximately 25° C./s. This avoids a case in which a theoretical critical cooling rate for obtaining equiaxed ferrite is approximately 2° C./s. Depending on a target steel-plate thickness, when an equivalent cooling rate at the center of a plate blank is not less than 25° C./s, to obtain a complete martensite structure, step (2-a) can be ignored; and when the equivalent cooling rate at the center of the plate blank is 2-25° C./s, a bainite structure is obtained. In this case, a final tempered bainite structure can also be obtained and a good strength/toughness ratio can be obtained only through step (2-c).

Preferably, after the treatment in step (1), if step (2-a) is not conducted, there is a more obvious correlation between mechanical properties (tensile strength and impact toughness) and a thickness position and a rolling direction of the steel ingot or ingot blank.

Preferably, before the off-line heat treatment in step (2), according to target toughness and steel-plate thickness requirements, cyclic phase transformation is introduced to refine initial austenite grains; the cyclic phase transformation occurs for not less than four times during high-temperature annealing at 675-775° C.; temperatures during all of the times are the same or different;

and when the temperatures are different during all of the times, a maximum of two temperatures are selected. For example, high-temperature annealing is conducted at ①750° C.→②675° C.→①750° C.→②675° C., the temperature is held for 1 h, and water cooling is conducted.

Preferably, a microscopic structure of steel obtained by treatment in step (2-a) is a lath martensite structure with a hierarchical structure (a martensite lath (lath), a lath block (block), a lath packet (packet), and prior austenite) and high dislocation density, and contains an extremely small amount of residual austenite (with a volume percent less than 2%).

Preferably, a microscopic structure of the steel treated by step (2-b) is a dual phase structure composed of a solute atom-depleted ferrite phase with low dislocation density and a solute atom-enriched martensitic phase with high dislocation density, where the ferrite phase and the martensitic phase are both body-centered cubic structures, and the squareness of the ferrite phase is higher than that of the martensitic phase; and the ferrite phase is 70%-85% and the martensitic phase is 15%-30% by volume percentage. A specific ratio mainly depends on the processing temperature and time of this step; the martensite phase (which may also be referred to as secondary martensite) is obtained by transformation by cooling reverse transformed austenite formed by reheating to high temperature (625-680° C.) after step (2-a) or step (1) (water cooling) to room temperature, and the ferrite phase evolves from prior lath martensite or bainite through high-temperature tempering.

Preferably, the microscopic structure obtained after treatment in step (2-b) further includes a dispersively distributed Cu-rich precipitated phase with an equivalent size of 18-35 nm and Mo, V, and Nb-rich alloy carbide with an equivalent size of 12-25 nm. The Cu-rich precipitated phase is of a face-centered cubic structure and is ellipsoidal, and maintains an incoherent interface with a matrix, and the alloy carbide is spherical, is also incoherent with the matrix, and is often formed adjacent to the Cu-rich precipitated phase. In this case, a dislocation bypass mechanism is used for strengthening the Cu-rich precipitated phase and the alloy carbide, and the strength contribution is relatively small.

Preferably, a dispersively distributed Cu-rich precipitated phase (or Cu-rich clusters) with an equivalent size less than 5 nm is further formed in the steel treated by step (2-c), where the Cu-rich precipitated phase is of a body-centered cubic structure (further includes a B2 structure) and is spherical, contains certain elements such as Fe and Ni, and maintains a coherent interface with a matrix. In this case, a dislocation cutting mechanism is used for strengthening the Cu-rich precipitated phase, and the strength contribution is relatively large. It is worth pointing out that no new alloy carbide is precipitated in this step, and its contribution to the strength can be ignored.

Preferably, after the treatment in step (2-c), features such as sizes and distribution of the Cu-rich precipitated phase and the alloy carbide obtained during the treatment in step (2-b) are basically unchanged.

Preferably, a thin-film austenite phase with a width of approximately 20 nm is further formed in the steel treated by step (2-c), where the austenite phase is of a face-centered cubic structure, and is mainly distributed formed at a related interface of the hierarchical structure of the martensite, especially an interface between a martensitic phase and a ferrite phase, and the austenite phase is 2%-7% by volume percentage.

Preferably, enrichment degrees of solute atoms such as Ni, Cu, and C in the ferrite phase, the martensitic phase, and the austenite phase increase sequentially. For example, based on weight percentage, when initial component is 7% Ni, the content of Ni content in the three phases are ~4.0%, ~9.1%, and 19.5%, respectively. The Ni content in this nano-austenite phase and a size and chemical stability that are determined by the Ni content can make the steel plate achieve impact toughness of −196° C.

Preferably, in consideration of process costs, combination forms of the heat treatment steps of the high-strength high-toughness low-temperature thick-plate structural steel may be: ①(1) (water cooling)[TMCP]; ②(1) (water cooling)÷(2-c)[TMCP+T]; ③(1) (water cooling)+(2-b)+(2-c)[TMCP÷L÷T]; ④(1)÷(2-a)+(2-b)+(2-c)[TMCP+Q+L÷T]. These processes are corresponding to different strength/toughness ratios, and are controlled by a steel-plate thickness.

Preferably, for the resulting high-strength high-toughness low-temperature thick-plate structural steel, when the strength is particularly considered, the yield strength is not less than 1200 MPa, a Charpy V-notch impact power at −40°

C. is greater than 55 J, a thickness is not less than 15 mm; and when the toughness is particularly considered, the yield strength is not less than 860 MPa, a Charpy V-notch impact power at −196° C. is greater than 75 J, and a thickness is not less than 20 mm.

The above heat treatment method can be used to produce wide and thick plate products made of low-temperature structural steel with different thicknesses and different strength/toughness ratios. The present invention can resolve a technical problem that existing high-strength high-toughness quenched and tempered steel cannot meet equipment requirements in polar resource and energy development, transportation, etc.

Compared with the prior art, the high-strength high-toughness low-temperature steel in the present invention can be adjusted to form thick-plate structural steel products with different strength/toughness ratios through an optimized combination of chemical composition and the heat treatment process. Particularly, when the strength is preferentially considered, after rolling, low-temperature thick-plate structural steel with the yield strength not less than 1200 MPa, a Charpy V-notch impact power at −40° C. greater than 55 J, and a thickness not less than 15 mm is obtained through off-line heat treatment of direct critical tempering in a two-phase region+conventional tempering; and when low-temperature toughness is preferentially considered, after rolling, low-temperature thick-plate structural steel with the yield strength not less than 860 MPa, a Charpy V-notch impact power at −196° C. greater than 75 J, and a thickness not less than 20 mm is obtained through off-line heat treatment of water quenching after austenitization+critical tempering in a two-phase region+conventional tempering.

The above low-temperature thick-plate structural steel has better comprehensive mechanical properties than existing commercial steel, can meet high-strength steel requirements of polar high performance ships and other extremely cold equipment, and can also meet requirements of LNG storage tanks for reducing weights and reducing costs. It should be particularly noted that, for the above mentioned two types of low-temperature thick-plate structural steel with different strength/toughness ratios, the performance of a process such as welding and long-term service performance such as corrosion performance have also been fully considered, and therefore the low-temperature thick-plate structural steel has relatively high technical maturity and application prospects.

The strength of the off-line heat treated high-strength high-toughness low-temperature steel in the present invention mainly comes from two aspects: one is composite precipitation strengthening of dispersively distributed second phases (Cu-rich precipitate, alloy carbide, etc.) of not less than two types; the second is precipitation strengthening of dispersively distributed Cu-rich nanoclusters (<5 nm). A mechanism thereof is as follows: 1. Formation temperature ranges of the Cu-rich precipitate and the alloy carbide are different, and precipitation kinetics thereof are also different, but the Cu-rich precipitate and the alloy carbide are often precipitated "adjacent to each other", that is, are subject to eutectoid precipitation. This is mainly because its nucleation and growth, have to repel element atoms needed by the other party, that is, the Cu-rich precipitate does not contain carbide-forming elements, and the alloy carbide does not contain elements such as Cu, Ni, and Al (Ni and Al tend to segregate at a Cu-rich precipitate/matrix interface). This eutectoid behavior of the alloy carbide and the Cu-rich precipitate increases the total nucleation positions of the second phases and prevents the second phases from growing excessively. This is an important condition for ensuring a precipitation strengthening effect. The foregoing case mainly occurs in a critical annealing (L) stage in a two-phase region. 2. The solid-solution content of a Cu element in a ferrite matrix is extremely low, even if Cu atoms form coarse Cu-rich precipitate with a relatively low strengthening effect through the pre-treatment (such as controlled cooling and high-temperature tempering), or diffused and distributed into reverse transformed austenite or secondary martensite that possibly exists, low-temperature tempering can still promote the formation of the Cu-rich precipitate in the ferrite matrix, thereby generating a considerable strengthening effect. The key lies in control of precipitation kinetics through tempering temperature and time to obtain coherent and dispersed nano Cu-rich precipitate. The foregoing case mainly occurs in a conventional tempering (T) stage. 3. A lath martensite structure of a hierarchical structure is obtained through rapid cooling (quenching) after austenitizing or rapid water cooling after rolling, that is, relevant interfaces and dislocations of "rich" martensite laths, lath blocks, lath packets, and prior austenite provide dispersed low-energy nucleation positions for the precipitation reaction in a subsequent tempering process, thereby generating more dispersed precipitation strengthening. The foregoing case mainly occurs during an austenite quenching (Q) stage.

The toughness of the off-line heat treated high-strength high-toughness low-temperature steel in the present invention mainly comes from two aspects: 1. A dual-phase microscopic structure composed of solute element-enriched secondary martensite+solute atom-depleted tempered martensite (corresponding to the above martensite phase and ferrite phase, respectively) is obtained through critical tempering in a two-phase region. Specifically, the secondary martensite is obtained by transformation after cooling reverse transformed austenite generated during the critical tempering in the two-phase region. Although the secondary martensite contains a relatively large number of solute elements, this is not enough to stabilize the austenite to room temperature. A volume fraction of the secondary martensite depends on the critical tempering temperature and time, and its content is approximately 15%-30% by volume percentage. The tempered martensite evolves from a quenched lath martensite structure through full tempering. In other words, the tempered martensite is a ferrite matrix. Due to the formation of the reverse transformed austenite and the precipitation of second phases, the solute element content of the tempered martensite is greatly reduced, and the content thereof is approximately 70%-85% by volume percentage. 2. During conventional tempering, nano reverse transformed austenite is precipitated near an interface between the secondary martensite and the ferrite matrix. Specifically, due to the enrichment of solute atoms, the reverse phase transformation temperature $A_{c1}$ of the secondary martensite is greatly reduced, and therefore the reverse phase transformation of austenite can occur at relatively low tempering temperature. Because more alloying elements (Ni content is ~19.5% by weight percentage) are enriched in austenite generated at this time, and a volume fraction of the austenite is relatively small (2%-7% by volume percentage), under a combined action of a chemical factor and a size factor, this part of nano-austenite has high enough stability, and can be retained to near the liquid nitrogen temperature without being decomposed. This is the key to ensure the toughness at −196° C.

According to the off-line heat treated high-strength high-toughness low-temperature steel in the present invention, a best strength/toughness ratio is obtained based on the process optimization of the multi-step heat treatment process, that is, determining of the coupling between the temperature and time (depending on a thick-plate thickness and target strength and toughness) and refinement of grains in the multi-step cycle annealing. The essence of a preparation process corresponding to a maximum strength/toughness ratio in the present invention lies in the flexible use of the precipitation and phase transformation theory, or precipitation strengthening, or stabilizing austenite for toughening, to maximize the function of alloying elements, namely, using a "pure matrix" concept as a guide for the process optimization.

DETAILED DESCRIPTION

High-strength high-toughness low-temperature thick-plate structural steel is provided, and is composed of the following components by weight percentage:

C: 0.03-0.08%, Cr: 0.8-1.9%, Mn: 0.01-1.0%, Ni: 3.5-7%, Mo: 0.2-0.5%, V: 0.15-0.2%, Nb: 0.01-0.05%, Cu: 1.2-3.8%, Al: 0-0.5%, P: <0.015%, S: <0.010%, and Fe and inevitable impurities as balance.

A heat treatment method of the high-strength high-toughness low-temperature thick-plate structural steel includes the following steps:

(1) conducting smelting according to a ratio to form a steel ingot or an ingot blank, and soaking at 1150-1250° C.; conducting a total of not less than 12 passes of rough rolling and finish rolling, where the final rolling temperature is not lower than 750° C., and a cumulative compression ratio is 4-7; and conducting air cooling or water cooling; and (2) conducting off-line heat treatment:

(2-a) quenching, denoted as Q: conducting austenization at 870-915° C. for 40-120 min, followed by water cooling;

(2-b) critical tempering in a two-phase region, denoted as L: conducting high-temperature tempering at 625-680° C. for 40-60 min, followed by water cooling; and (2-c) tempering, denoted as T: conducting tempering at 525-575° C. for 30-360 min, followed by air cooling; where when air cooling is conducted after rolling in step (1), the off-line heat treatment includes step (2-a), step (2-b), and step (2-c) to obtain the high-strength high-toughness low-temperature thick-plate structural steel; and when water cooling is conducted after rolling in step (1), the off-line heat treatment includes step (2-a), step (2-b), and step (2-c), or sequentially conducting step (2-b) and step (2-c), to obtain the high-strength high-toughness low-temperature thick-plate structural steel.

The present invention is described in detail below with reference to the accompanying drawings and specific examples.

High-strength high-toughness low-temperature thick-plate structural steel is provided, and composed of the following components by weight percentage: C: 0.045%, Cr: 1.9%, Mn: 0.01%, Ni: 6.89%, Mo: 0.49%, V: 0.19%, Nb 0.01%, Cu: 3.77%, P<0.015%, S<0.010%, and Fe and inevitable impurities as balance.

Figure 1:
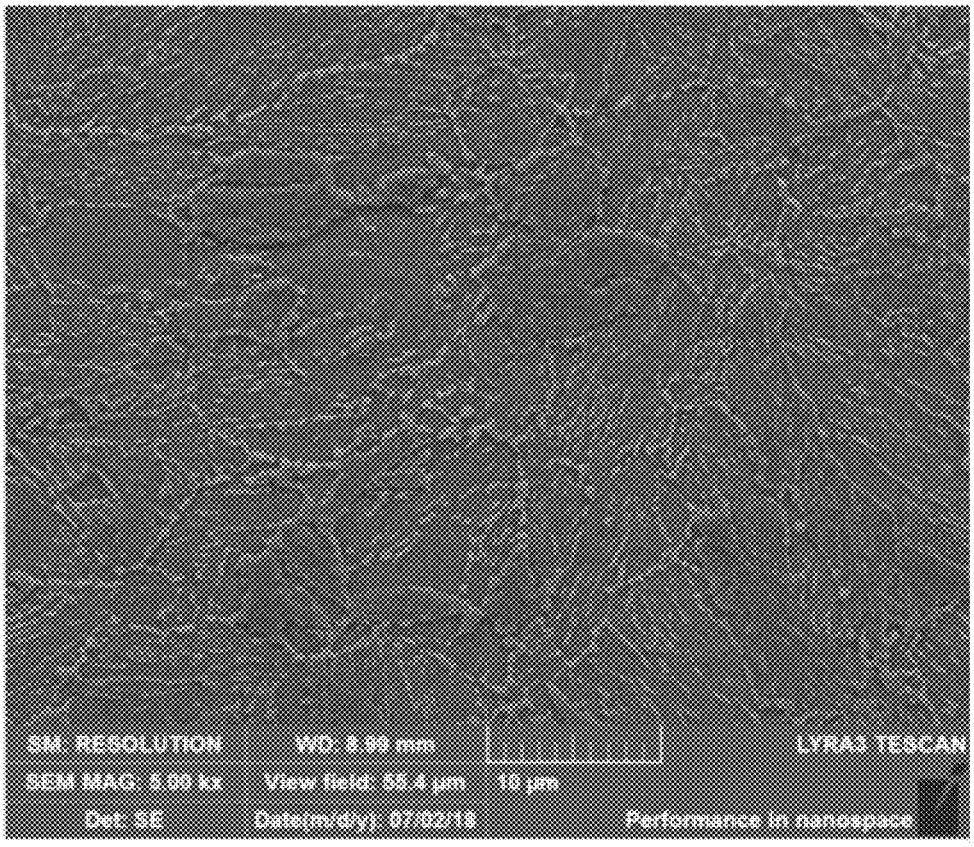
FIG. 1 shows a typical SEM microscopic structure of a sample of high-strength high-toughness low-temperature thick-plate structural steel in the present invention that is rolled and air-cooled and then subject to austenitized quenching at 900° C.+critical tempering in a two-phase region+conventional tempering (QL675T), where a "protrusion" indicates that a martensite phase exists.

A dual phase structure: a basic microscopic structure of the high-strength high-toughness low-temperature thick-plate structural steel includes two phases, one is a solute atom-depleted ferrite phase with low dislocation density, and the other is a solute atom-enriched martensitic phase with high dislocation density. To be specific, the dual phase structure is shown in FIG. 1. The two phases are both body-centered cubic structures, and the squareness of the ferrite phase is higher than that of the martensitic phase. Solute atoms (enriched or depleted) herein mainly refer to elements such as Ni, Cu, C, and Mn that possibly exists. This dual phase structure is obtained by heating and quenching a single lath martensite structure in a critical region (a two-phase region of austenite+ferrite), in which austenite reversely transformed at high temperature is cooled and transformed into the solute atom-enriched martensite phase (or secondary martensite) with high dislocation density, while prior martensite that is not subject to phase transformation evolves into the solute atom-depleted ferrite phase with low dislocation density. A ratio (volume fractions) of the two phases mainly depends on the critical tempering temperature and time determined by a target strength/toughness ratio and a steel-plate thickness. In a final stage of conventional low-temperature tempering, there are no substantial changes in the microtopography, crystal structure, and composition, of the two phases.

Figure 2:
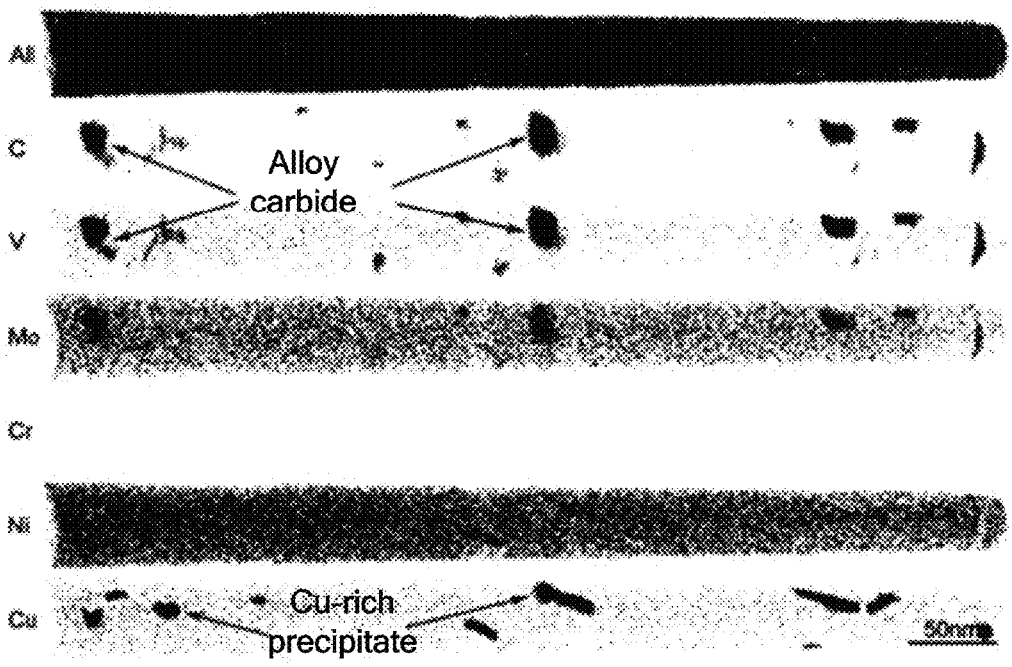
FIG. 2 is a distribution diagram of V and Mo-rich alloy carbide and a Cu-rich precipitated phase that is obtained through an atom probe tomography (APT) technology conducted on a sample of high-strength high-toughness low-temperature thick-plate structural steel in the present invention that is rolled and air-cooled and then subject to austenitized quenching at 900° C.+critical tempering in a two-phase region (QL675)

Precipitated strengthened phase: The strength of the high-strength high-toughness low-temperature thick-plate structural steel mainly comes from: 1. dispersively distributed Cu-rich precipitated phase and alloy carbide that are precipitated adjacent to each other, as shown in FIG. 2. The Cu-rich precipitated phase and the alloy carbide are mainly formed in a tempered martensite (ferrite) matrix during high-temperature critical tempering (L), and are mainly distributed at a martensite lath interface and a prior austenite crystal boundary. The Cu-rich precipitate is ellipsoidal or long rod-shaped, is of a face-centered cubic structure, and has an equivalent size of 18-35 nm. An interface between the Cu-rich precipitate and the ferrite matrix is a smooth interface, and Ni and Mn tend to segregate at this interface and prevent the Cu-rich precipitate from being excessively coarsened. The alloy carbide is spherical, is of a face-centered cubic structure (NaCl crystal structure), and has an equivalent size of approximately 20 nm. The alloy carbide mainly contains V and a certain amount of Mo, that is, the alloy carbide is (V,Mo)C or ($(V,Mo)_4C_3$) carbide, and has good resistance to tempering and roughening. The Cu-rich precipitated phase and the alloy carbide are often formed adjacent to each other, that is, are subject to eutectoid precipitation. This is mainly because its nucleation and growth increase necessary forming elements for the other party. A precipitation strengthening effect of the Cu-rich precipitate and the alloy carbide formed by high-temperature critical tempering is reduced. The foregoing case mainly involves a strengthening mechanism in which dislocations bypass a second phase. 2. The dispersively distributed nano-sized Cu-rich precipitated phase (or Cu-rich clusters) is formed in a conventional low-temperature tempering (T) stage. The solid-solution content of a Cu element in the ferrite matrix is extremely low, even if Cu atoms form coarse Cu-rich precipitate with a relatively low strengthening effect through the pre-treatment (such as critical tempering), or diffused and distributed into reverse transformed austenite or secondary martensite that possibly exists, the matrix still contains a certain amount of Cu atoms in a solid solution state (a weight percentage ratio thereof is approximately 0.8%-1.2%). Atom probe tomography technology APT component analysis results are shown in a distribution diagram of Cu atoms in FIG. 2. During low-temperature tempering, the Cu atoms are further precipitated to form a more dispersed nano Cu-rich phase (<5 nm). The nano Cu-rich phase has a B2 or 9R crystal structure, and maintains a coherent or semi-coherent interface relationship with the matrix, so as to effectively hinder dislocation motion. The foregoing case involves a strengthening mechanism in which dislocations cut through the second phase, thereby making up for the reduction in overall strength resulting from high-temperature critical tempering.

Figure 3:
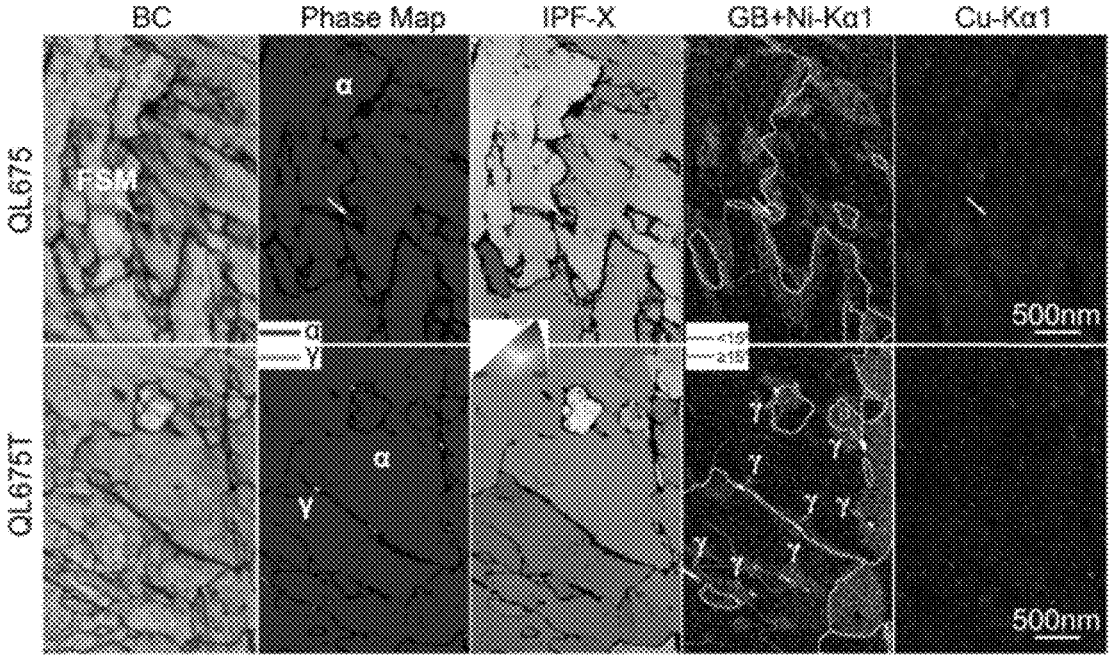
FIG. 3 is EBSD microscopic structures and EDS surface scanning component distribution of Ni and Cu elements of a sample of high-strength high-toughness low-temperature thick-plate structural steel in the present invention that is rolled and air-cooled and then subject to austenitized quenching at 900° C.+critical tempering in a two-phase region (QL675) and a sample of high-strength high-toughness low-temperature thick-plate structural steel that is rolled and air-cooled and then subject to austenitized quenching at 900° C.+critical tempering in a two-phase region+conventional tempering (QL675T), where a thin-film austenite phase of a face-centered cubic structure exists only in the QL675T condition.

Nano-austenite phase: reverse transformed austenite (γ phase) is in a shape of a thin film, formed in a conventional low-temperature tempering (T) stage, and mainly distributed at an interface between secondary martensite (FSM) and the ferrite matrix (a phase), as shown in EBSD analysis results in FIG. 3. Solute atom-enriched secondary martensite formed during the critical tempering (L) in a two-phase region plays a key role in the nucleation and growth of nano-austenite. Specifically, due to the enrichment of solute atoms, the reverse transformation temperature $A_{c1}$ of the secondary martensite is greatly reduced, so that the reverse transformation of austenite can occur at relatively low tempering temperature. A thickness of the nano-austenite thin film is approximately 20 nm, and the thin film contains relatively content of Ni that can reach up to ~20 wt %, and also contains relatively high content of Cu and C. Because of the enrichment of alloying elements and a nanometer size effect, such reverse transformed austenite has relatively high stability, and even can be retained to liquid nitrogen temperature without being decomposed, thereby ensuring the low-temperature toughness.

Smelting is conducted according to the above ratio to form a steel ingot or an ingot blank, and soaking is conducted at 1200° C.; multiple passes of rolling such as rough rolling and finish rolling are conducted, where the final rolling temperature is 760° C., and a cumulative compression ratio is 6; air cooling is conducted after rolling; and off-line heat treatment is conducted, mainly including three steps: first heating to 900° C., holding the temperature for 60 min, followed by water quenching (Q); then conducting high-temperature tempering at 675° C. for 60 min (L); and finally tempering at 550° C. for 60 min (T). The above microscopic structure and nanostructure are obtained through adjustment according to this QLT off-line heat treatment process, to obtain extremely low-temperature thick-plate structural steel with the yield strength not less than 860 MPa, a minimum Charpy V-notch impact power at −196° greater than 75 J, and a thickness not less than 20 mm.

Figure 4:
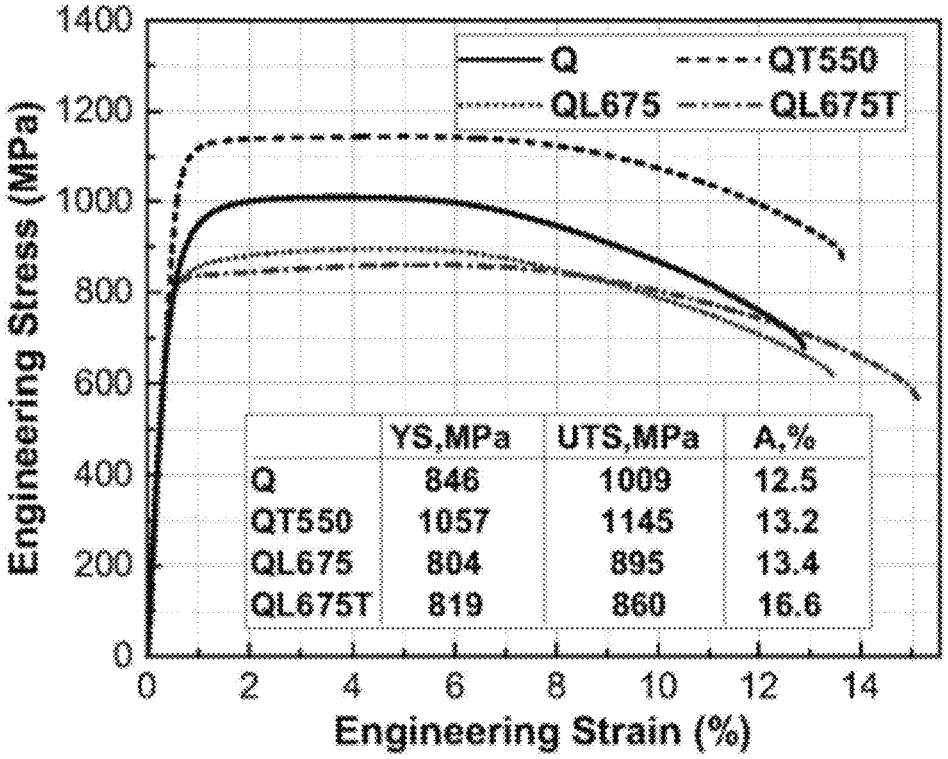
FIG. 4 shows a tensile curve and performance indexes at room temperature (as shown in an inserted table) of a sample of high-strength high-toughness low-temperature thick-plate structural steel in the present invention that is rolled and air-cooled and then subject to austenitized quenching (Q) at 900° C., quenching+conventional tempering (QT550)/critical tempering in a two-phase region (QL675), critical tempering in the two-phase region+conventional tempering (QL675T)

Tensile strength (shown in FIG. 4): the as-quenched Q strength mainly comes from the dislocation strengthening and solid solution strengthening of lath martensite; the quenched and tempered state QT strength mainly comes from composite precipitation strengthening (dislocation and solid solution strengthening effects are reduced) of nano second phases (Cu-rich precipitate and alloy carbide); the strength obtained after critical tempering L in a two-phase region mainly comes from dual-phase strengthening (a strengthening effect of the second phases is reduced due to coarsening) of the secondary martensite and a tempered martensite matrix. The final QLT strength mainly comes from dual-phase strengthening, interface strengthening, and nano Cu-rich clusters precipitated during a T process (to compensate for a tempering softening effect of the matrix during L and T processes). It should be noted that a QLT sample has the highest plasticity (elongation is 16.6%). This is based on the following aspects: 1. a coordinated deformation effect of nano reverse transformed austenite at an interface; 2. nano Cu-rich clusters are more likely to be cut by dislocations without causing stress concentration, thereby generating strengthening without reducing plasticity.

Figure 5:
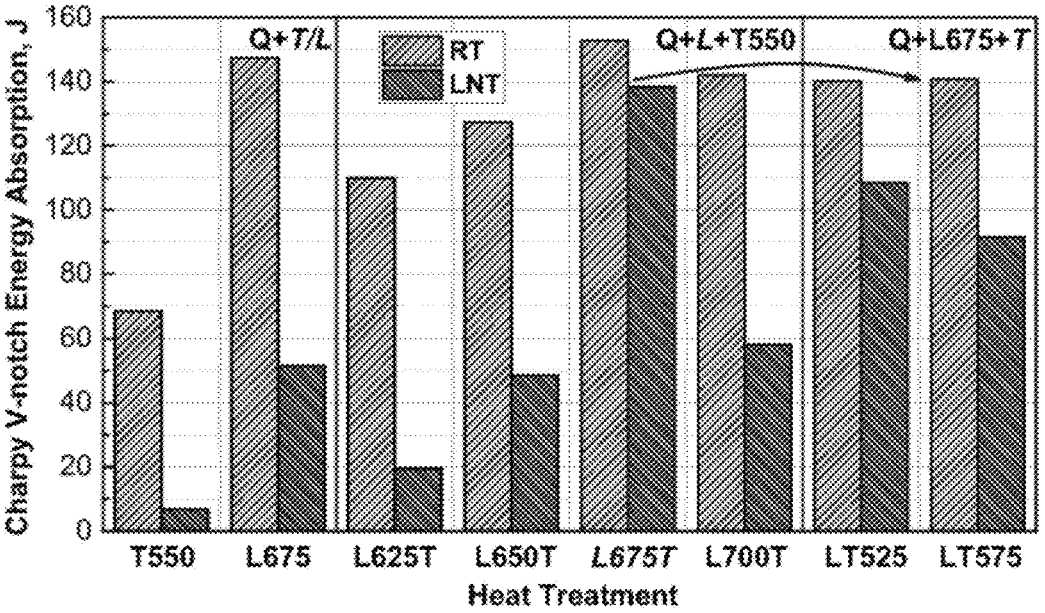
FIG. 5 shows room-temperature (23° C., RT) and low-temperature (−196° C., LNT) impact performance of a sample of high-strength high-toughness low-temperature thick-plate structural steel in the present invention that is rolled and air-cooled and then subject to austenitized quenching at 900° C.+critical/conventional tempering (Q+T/L: T550; L675), quenching+critical tempering+conventional tempering at 550° C. (Q+L+T: L625T; L650T; L675T; and L700T), quenching+critical tempering at 675° C.+conventional tempering (Q+L675+T: LT525; LT550 (same as L675T); and LT575)

Impact toughness (shown in FIG. 5): For different heat treatment steps and parameter (temperature) coupling processes, only a QL675T550 sample can maintain both relatively high room temperature and impact toughness at −196° C. This is based on the following aspects: 1. A dual phase structure composed of martensite+ferrite (or secondary martensite+tempered martensite); 2. nano reverse transformed austenite precipitated at an interface; 3. a potential toughening effect of Cu-rich precipitate coarsened during critical tempering L.

Figure 6:
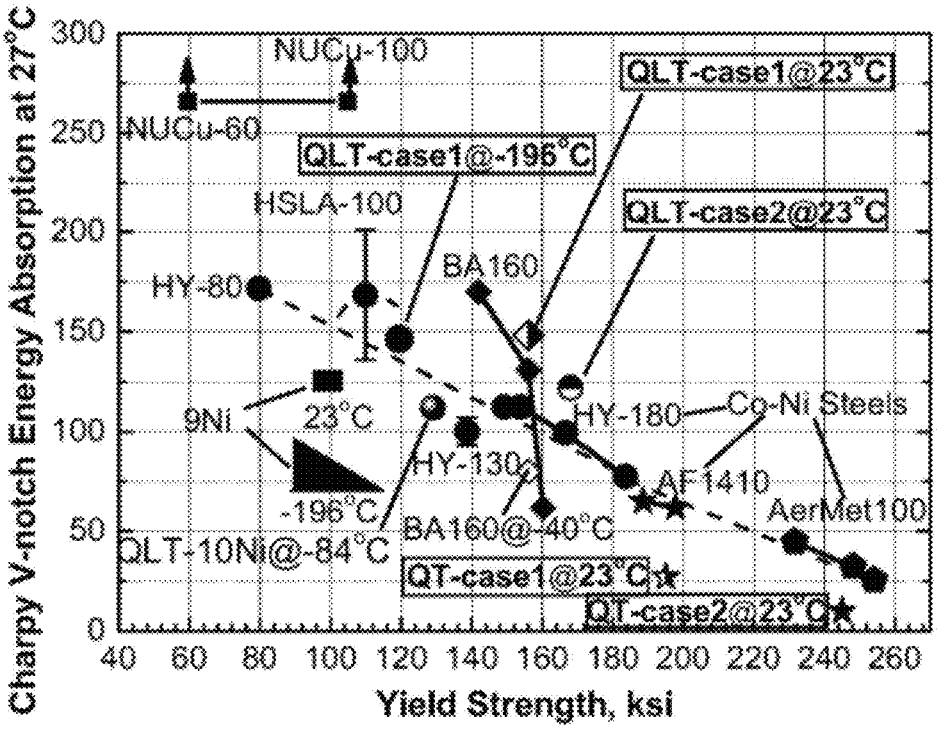
FIG. 6 is a comparison diagram of mechanical properties (strength-impact toughness relationships) of high-strength high-toughness low-temperature thick-plate structural steel in the present invention and some commercial/prototype high-strength high-toughness thick-plate structural steel, where QT: austenitized quenching at 900° C.+conventional tempering at 500-550° C.; QLT: austenitized quenching at 900° C.+critical tempering in a two-phase region at 650-675° C.+conventional tempering at 500-550° C.; Case 1: Al-free alloy steel; Case 2: Al-containing alloy steel; and unless otherwise specified, all impact powers are room-temperature values.

FIG. 6 shows a comparison between strength/toughness ratios of high-strength high-toughness low-temperature thick-plate structural steel in the present invention and some commercial/prototype steel. After conventional quenching and tempering treatment, an illustrated QT-case1 sample, and an illustrated QT-case2 sample to which a small amount of Al is added both show extremely high strength, but their toughness cannot meet engineering application requirements. Therefore, a critical tempering (L) process in a two-phase region is introduced: For the QLT-case1 sample, that is, a sample (QL675T) that is rolled and air-cooled, held at 900° C. and water quenched for 30 min, held at 675° C. and water quenched for 1 h, and held at 550° C. and water quenched for 1 h), at the liquid nitrogen temperature (−196° C.), a strength/toughness ratio of the sample is far higher than that of existing 9Ni low-temperature steel; and at room temperature (23° C.), a strength/toughness ratio of the sample is better than that of Co-containing HY-180 steel; while the strength of the QLT-case2 sample is further improved (a part of the toughness is sacrificed). It can be learned that, through an optimized heat treatment process, the high-strength high-toughness low-temperature thick-plate structural steel in this project can achieve better comprehensive mechanical properties than existing commercial alloy steel.

The above description of the examples is intended to facilitate a person of ordinary skill in the art to understand and use the present invention. Obviously, a person skilled in the art can easily make various modifications to these examples, and apply a general principle described herein to other examples without creative efforts. Therefore, the present invention is not limited to the above examples. All improvements and modifications made by a person skilled in the art according to the disclosure of the present invention should fall within the protection scope of the present invention.

What is claimed is:

1. A heat treatment method for structural steel, the structural steel being composed of the following components by weight percentage:

C: 0.03-0.08%, Cr: 0.8-1.9%, Mn: 0.01-1.0%, Ni: 3.5-7%, Mo: 0.2-0.5%, V: 0.15-0.2%, Nb: 0.01-0.05%, Cu: 1.2-3.8%, Al: 0-0.5%, P: <0.015%, S: <0.010%, and Fe and inevitable impurities as balance;

wherein the heat treatment method comprises the following steps:

(1) conducting smelting according to a ratio to form a steel ingot or an ingot blank, and soaking at 1150-1250° C.; conducting a total of not less than 12 passes of rough rolling and finish rolling, wherein the final rolling temperature is not lower than 750° C., and a cumulative compression ratio is 4-7; and conducting air cooling or water cooling; and (2) conducting off-line heat treatment, comprising:

(2-a) quenching, denoted as Q: conducting austenization at 870-915° C. for 40-120 min, followed by water cooling;

(2-b) critical tempering in a two-phase region, denoted as L: conducting high-temperature tempering at 625-680° C. for 40-60 min, followed by water cooling; or (2-c) tempering, denoted as T: conducting tempering at 525-575° C. for 30-360 min, followed by air cooling; wherein when air cooling is conducted after rolling in step (1), the off-line heat treatment comprises step (2-a), step (2-b), and step (2-c) to obtain the structural steel; and when water cooling is conducted after rolling in step (1), the off-line heat treatment comprises step (2-a), step (2-b), and step (2-c), or sequentially conducting step (2-b) and step (2-c), to obtain the structural steel.

2. The heat treatment method according to claim 1, wherein a microscopic structure of steel obtained by treatment in step (1) is mainly martensite and/or bainite.

3. The heat treatment method according to claim 2, wherein a microscopic structure of the steel treated by step (2-a) is a lath martensite structure with a hierarchical structure and high dislocation density, and contains residual austenite with a volume percent less than 2%.

4. The heat treatment method according to claim 3, wherein a microscopic structure of the steel treated by step (2-b) is a dual phase structure composed of a solute atom-depleted ferrite phase with low dislocation density and a solute atom-enriched martensitic phase with high dislocation density, wherein the ferrite phase and the martensitic phase are both body-centered cubic structures, and the squareness of the ferrite phase is higher than that of the martensitic phase; and the ferrite phase is 70%-85% and the martensitic phase is 15%-30% by volume percentage.

5. The heat treatment method according to claim 4, wherein the microscopic structure of the steel treated by step (2-b) further comprises a dispersively distributed Cu-rich precipitated phase with an equivalent size of 18-35 nm and Mo, V, and Nb-rich alloy carbide with an equivalent size of 12-25 nm, wherein the Cu-rich precipitated phase is of a face-centered cubic structure and is ellipsoidal, and maintains an incoherent interface with a matrix, and the alloy carbide is spherical, is also incoherent with the matrix, and is often formed adjacent to the Cu-rich precipitated phase.

6. The heat treatment method according to claim 4, wherein a dispersively distributed Cu-rich precipitated phase with an equivalent size less than 5 nm is further formed in the steel treated by step (2-c), the Cu-rich precipitated phase is of a body-centered cubic structure and is spherical, and maintains a coherent interface with a matrix; in addition, a thin-film austenite phase of a face-centered cubic structure and with a width of 20 nm is formed at an interface between a martensitic phase and a ferrite phase, and the austenite phase is 2%-7% by volume percentage.

7. The heat treatment method according to claim 6, wherein enrichment degrees of solute atoms Ni in the ferrite phase, the martensitic phase, and the austenite phase increase sequentially.

8. The heat treatment method according to claim 2, wherein a microscopic structure of the steel treated by step (2-b) is a dual phase structure composed of a solute atom-depleted ferrite phase with low dislocation density and a solute atom-enriched martensitic phase with high dislocation density, wherein the ferrite phase and the martensitic phase are both body-centered cubic structures, and the squareness of the ferrite phase is higher than that of the martensitic phase; and the ferrite phase is 70%-85% and the martensitic phase is 15%-30% by volume percentage.

9. The heat treatment method according to claim 8, wherein the microscopic structure of the steel treated by step (2-b) further comprises a dispersively distributed Cu-rich precipitated phase with an equivalent size of 18-35 nm and Mo, V, and Nb-rich alloy carbide with an equivalent size of 12-25 nm, wherein the Cu-rich precipitated phase is of a face-centered cubic structure and is ellipsoidal, and maintains an incoherent interface with a matrix, and the alloy carbide is spherical, is also incoherent with the matrix, and is often formed adjacent to the Cu-rich precipitated phase.

10. The heat treatment method according to claim 8, wherein a dispersively distributed Cu-rich precipitated phase with an equivalent size less than 5 nm is further formed in the steel treated by step (2-c), the Cu-rich precipitated phase is of a body-centered cubic structure and is spherical, and maintains a coherent interface with a matrix; in addition, a thin-film austenite phase of a face-centered cubic structure and with a width of 20 nm is formed at an interface between a martensitic phase and a ferrite phase, and the austenite phase is 2%-7% by volume percentage.

11. The heat treatment method according to claim 10, wherein enrichment degrees of solute atoms Ni in the ferrite phase, the martensitic phase, and the austenite phase increase sequentially.

12. The heat treatment method according to claim 1, wherein for the resulting structural steel, when the strength is particularly considered, the yield strength is not less than 1200 MPa, a Charpy V-notch impact power at −40° C. is greater than 55 J, a thickness is not less than 15 mm; and when the toughness is particularly considered, the yield strength is not less than 860 MPa, a Charpy V-notch impact power at −196° C. is greater than 75 J, and a thickness is not less than 20 mm.

13. The heat treatment method according to claim 1, wherein before step (2-a) of the off-line heat treatment, according to target strength and toughness and steel-plate thickness requirements, a cyclic phase transformation is introduced to refine initial austenite grains; the cyclic phase transformation occurs for not less than four times during high-temperature annealing at 675-775° C.; temperatures during all of the times are the same or different; and when the temperatures are different during all of the times, a maximum of two temperatures are selected.

* * * * *